US005277547A

United States Patent [19]

Washizu

[11] Patent Number: 5,277,547

[45] Date of Patent: Jan. 11, 1994

[54] MOTOR FAN UNIT

[75] Inventor: Katsushi Washizu, Numazu, Japan

[73] Assignee: Usui Kokusai Sangyo Kaisha Ltd., Japan

[21] Appl. No.: 884,695

[22] Filed: May 18, 1992

[30] Foreign Application Priority Data

May 18, 1991 [JP] Japan ..... 3-142595

[51] Int. Cl.[5] ..... F04D 29/44

[52] U.S. Cl. ..... 415/208.1; 415/209.2; 165/122; 417/423.5

[58] Field of Search ..... 415/208.1, 209.2, 209.3, 415/210.1; 165/122; 417/433.5, 423.14

[56] References Cited

U.S. PATENT DOCUMENTS 3,366,169 1/1968 Laing ..... 165/122
3,384,165 5/1968 Mathews ..... 165/122
5,135,046 8/1992 Becquerel et al. ..... 165/122

FOREIGN PATENT DOCUMENTS 54-164325 11/1979 Japan .
0175418 4/1985 Japan ..... 165/122
61-20430 2/1986 Japan .
61-162530 10/1986 Japan .

*Primary Examiner*—Edward K. Look
*Assistant Examiner*—Mark Sgantzos
*Attorney, Agent, or Firm*—Anthony J. Casella; Gerald E. Hespos

[57] ABSTRACT

A twin motor fan unit is provided with two fan members mounted to parallel rotational shafts of a motor. The motor fan unit includes a rectifying plate to partition the fan members. The rectifying plate prevents turbulence at the rear faces of the respective fans that would otherwise be caused by mutual interference of the air stream leaving the fan. As a result, the motor fan unit enables an increased quantity of air to flow through the motor fan unit and also achieves a reduction in operating noise.

11 Claims, 4 Drawing Sheets

MOTOR FAN UNIT

BACKGROUND OF THE INVENTION

1. Field of the Invention

The present invention relates to a motor fan unit incorporated in a cooling system such as a radiator or a condenser for automobiles.

2. Description of the Related Art

A prior art motor fan unit, normally is single fan member mounted to a rotation shaft of a motor. But recently, a twin type motor fan unit wherein each fan member is disposed and mounted in parallel to accelerate its function has been developed.

However, such twin type motor fan unit has a problem that, due to the peculiar construction of the fan members disposed in parallel, a mutual interference of cooling winds generated by the fan members when the fan members are turned causes a turbulence in the fan's rear stream, thereby hampering a smooth flow of air, decreasing the cooling capacity and inducing noise inevitably.

SUMMARY OF THE INVENTION

Accordingly, it is an object of the present invention to solve the aforementioned problem of the prior art by providing a motor fan unit that can suppress the mutual interference of the fan's rear streams of the cooling air to smooth the flow of air to further accelerate the cooling effect, and, at the same time, to eliminate the induction of noise and to improve the performance of the fan unit.

In order to attain the aforementioned goal, according to the present invention, in a twin motor fan unit wherein each fan member is disposed in parallel and mounted to each rotation shaft of a motor, the motor fan unit is structured so that it is partitioned by a rectifying plate placed between those fan members. The rectifying plate is extended especially to the rear stream side and is structured in approximately S-shape, I-shape, X-shape, Y-shape or in slant-shape or by shielding directly by part of a shroud.

Since the present invention is structured as described above, spiral rear streams of the fans generated by each fan member when the fan unit is turned are rectified within the partition along the rectifying plate, so that the turbulence caused by the mutual interference of the fan's rear stream may be eliminated and the flow of air may be smoothed. Thereby, it allows air quantity to be increased, the cooling effect to be further accelerated and, at the same time, the induction of noise due to the interference to be eliminated and the overall performance to be improved.

BRIEF DESCRIPTION OF THE DRAWINGS

The above advantages of the invention will become more apparent in the following description and the accompanying drawings in which like numerals refer to like parts throughout several views in which.

DETAILED DESCRIPTION OF PREFERRED EMBODIMENTS

Figure 1:
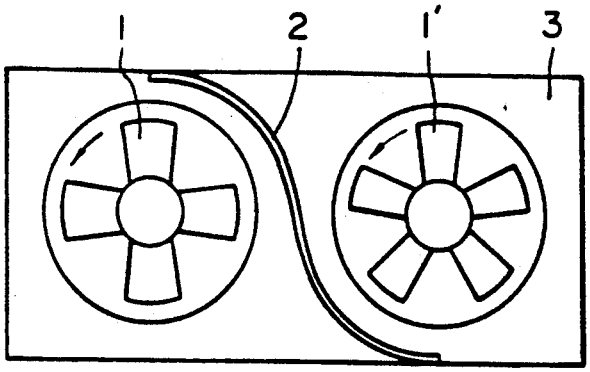
FIG. 1 is a schematic front view of a motor fan unit of one preferred embodiment of the present invention.
Figure 2:
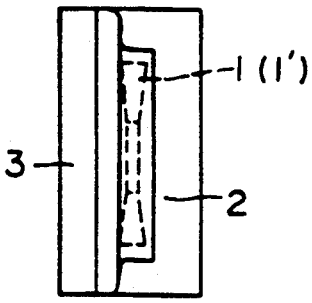
FIG. 2 is a side view of the embodiment in FIG. 1.
Figure 3:
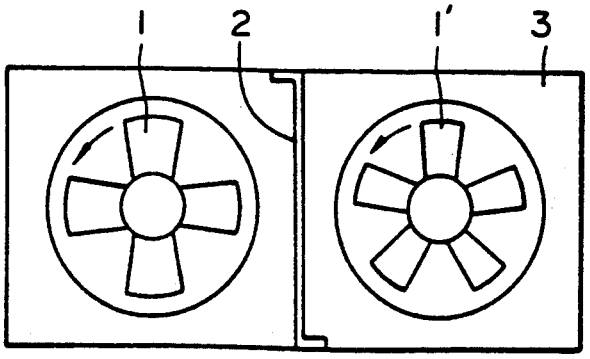
FIG. 3 is a view equivalent to FIG. 1 illustrating another embodiment.
Figure 4:
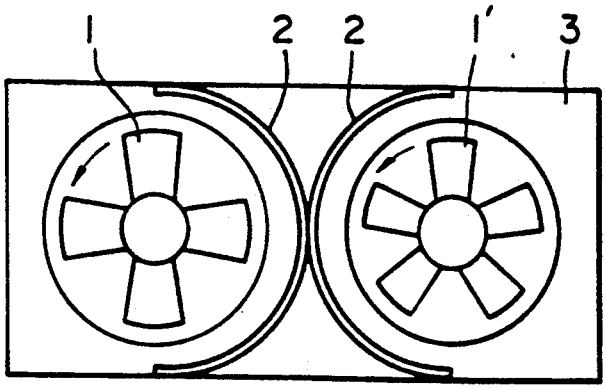
FIG. 4 is a view equivalent to FIG. 1 illustrating still another embodiment.
Figure 5:
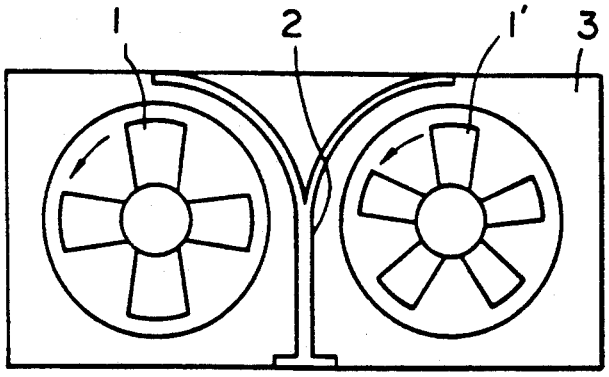
FIG. 5 is a view equivalent to FIG. 1 illustrating a further embodiment.
Figure 6:
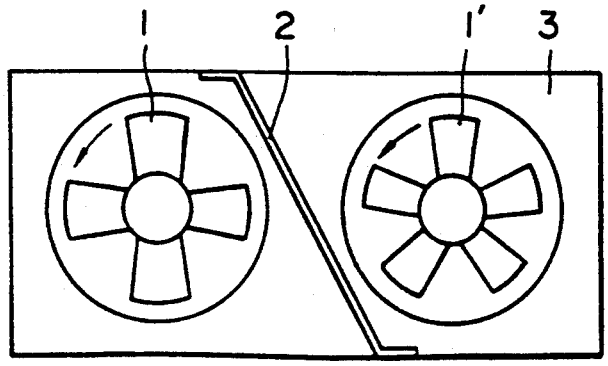
FIG. 6 is a view equivalent to FIG. 1 illustrating a still further embodiment.
Figure 7:
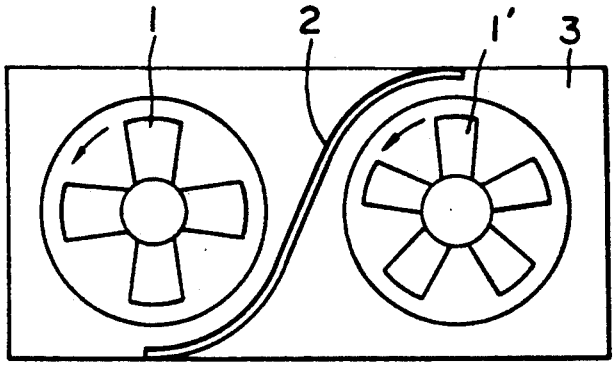
FIG. 7 is a view equivalent to FIG. 1 illustrating another embodiment.
Figure 8:
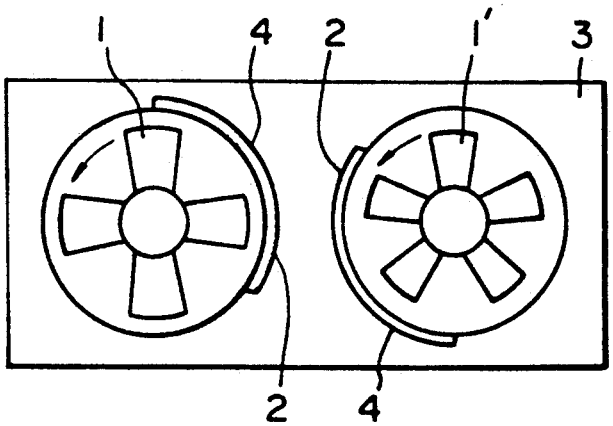
FIG. 8 is a view equivalent to FIG. 1 illustrating a further embodiment.

Referring now to the drawings, preferred embodiments of the present invention will be explained. FIG. 1 is a front view illustrating a motor fan unit of one preferred embodiment of the present invention, FIG. 2 is a side view of the embodiment in FIG. 1 and FIGS. 3 through 8 are views equivalent to FIG. 1 illustrating other embodiments. In the figures, axial fan members 1 and 1'are disposed in parallel and mounted to rotation shafts of a motor (not shown) as a twin type motor fan unit. A rectifying plate 2 partitions the fan members 1 and 1' and is constructed in approximately Z-shape (FIG. 1), I-shape (FIG. 3), X-shape (FIG. 4), Y-shape (FIG. 5), slant-shape (FIG. 6) or in S-shape (FIG. 7) or by directly shielding by shields 4 (FIG. 8) which are part of a shroud 3.

As a result of performance tests of the present invention carried out using the rectifying plate 2 in FIG. 1 by comparing to the prior art which missed only the rectifying plate under the same conditions using the fan members 1 and 1' (four blades with 320 mm of diameter and five blades having the same size combined with a condenser, a radiator and a shroud) in each speed of rotation (1827 to 1880 rpm at the four-blade side, 1857 to 1876 rpm at the five-blade side), the total air quantity increased from 45.34 $m^3$/min. to 46.25 $m^3$/min., improving about 2% of air quantity.

Figure 9A:
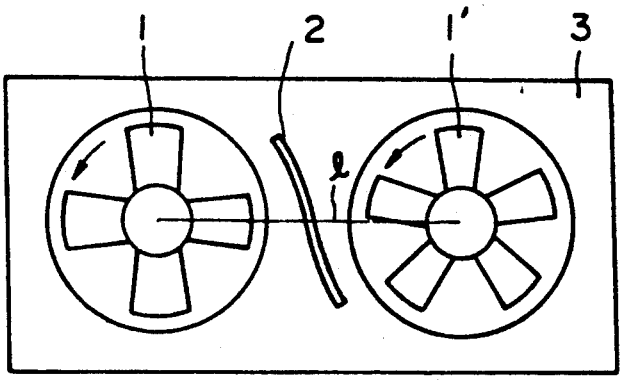
FIG. 9*a* is a plan view showing still another embodiment.
Figure 9B:
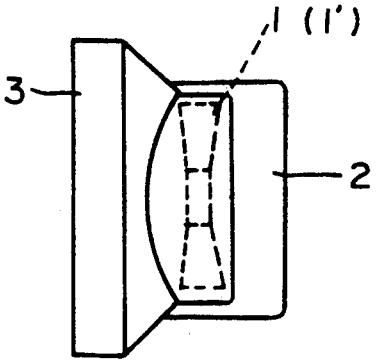
FIG. 9*b* is a side view of the embodiment shown in FIG. 9*a*.

FIGS. 9*a* and 9*b* show a still another embodiment wherein the rectifying plate 2 is provided only, near a line (1) connecting rotation centers of the fan members 1 and 1' with each other.

Figure 10:
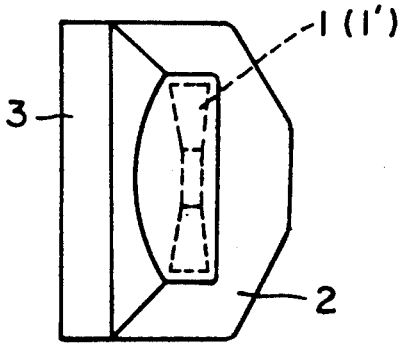
FIG. 10 is a view equivalent to FIG. 1 showing a still further embodiment.

FIG. 10 shows a still further embodiment wherein the rectifying plate 2 is provided on the line (1) connecting the rotation centers of the fan members 1 and 1' with each other has a height higher than that of any other members.

The rectifying plate 2 as shown in FIGS. 9*a* and 9*b* or FIG. 10 provides the same effect as described in the foregoing.

As described above, the motor fan unit of the present invention is structured so that at least the fan's rear stream side (the discharge side) of the fan members 1 and 1' is partitioned by the rectifying plate 2, so that the mutual interference in the fan's spiral rear streams due to the fan members 1 and 1' may be eliminated and the air flow may be smoothed along the rectifying plate. Accordingly, it allows the air quantity to be increased, the cooling effect to be further accelerated and in the same time, the induction of noise to be eliminated and the overall performance as a fan unit to be improved.

It is understood that by those skilled in the art that the foregoing description is preferred embodiments of the disclosed device and that various changes and modifications may be made in the invention without departing from the spirit and scope thereof.

What is claimed is:

1. A twin fan unit comprising first and second fan members mounted respectively to first and second substantially parallel rotatable shafts, said fan unit having a front side orthogonal to said shafts for receiving air and a rear side orthogonal to said shafts for directing first and second rear streams of air from the respective first and second fan members and generally parallel to the shafts, said twin fan unit further including a rectifying plate disposed intermediate said first and second fan members and projecting rearwardly therefrom, said rectifying plate suppressing mutual interference of the first and second rear streams of the fan members for achieving a smooth flow of air and for reducing noise.

2. A twin fan unit as in claim 1, wherein said fan members are substantially coplanar.

3. A twin fan unit as in claim 1, wherein said rectifying plate is substantially parallel to said rotatable shafts.

4. A twin fan unit as in claim 3, wherein said rectifying plate is substantially S-shape.

5. A twin fan unit as in claim 3, wherein said rectifying plate is substantially X-shape.

6. A twin fan unit as in claim 3, wherein said rectifying plate is substantially Y-shape.

7. A twin fan unit as in claim 3, wherein said rectifying plate is substantially I-shape.

8. A twin fan unit as in claim 3, wherein said rectifying plate is substantially Z-shape.

9. A twin fan unit as in claim 1, wherein said rectifying plate extends partly around the first fan member, said twin fan unit further comprising a second rectifying plate extending partly around the second fan member.

10. A twin fan unit as in claim 9, wherein said rectifying plates are connected to one another.

11. A twin fan unit as in claim 9, wherein said rectifying plates are spaced from one another.

* * * * *

UNITED STATES PATENT AND TRADEMARK OFFICE

CERTIFICATE OF CORRECTION

PATENT NO. : 5,277,547

DATED : January 11, 1994

INVENTOR(S) : Osamu Akama and Yoshiyuki Mita

It is certified that error appears in the above-indentified patent and that said Letters Patent is hereby corrected as shown below:

On the title page, under item [19], "Washizu" should read --Akama, et al.-- and item [75] should read as follows:

--Osamu Akama, Tagata-gun, Japan
Yoshiyuki Mita, Tagata-gun, Japan--.

Signed and Sealed this

Twelfth Day of July, 1994

*Attest:*

Bruce Lehman

BRUCE LEHMAN

*Attesting Officer*

*Commissioner of Patents and Trademarks*